US005782297A

United States Patent [19]

Samuels et al.

[11] Patent Number: 5,782,297

[45] Date of Patent: Jul. 21, 1998

[54] RETRIEVAL TOOL FOR BACK PRESSURE VALVE AND TREE TEST PLUG

[75] Inventors: Martin L. Samuels, Nashville, Tenn.; Bashir M. Koleilat, Forest Spring, Tex.; David E. Cain; John R. Herold, both of Houston, Tex.; Neil C. Crawford, Forest Spring, Tex.; Henry Wong, Houston, Tex.

[73] Assignee: FMC Corporation, Chicago, Ill.

[21] Appl. No.: 699,317

[22] Filed: Aug. 19, 1996

[51] Int. Cl.[6] ..... E21B 23/00

[52] U.S. Cl. ..... 166/85.1; 166/98; 166/237; 294/86.18; 294/86.25

[58] Field of Search ..... 166/85.1, 85.3, 166/85.5, 98, 217, 237; 294/86.18, 86.25

[56] References Cited

U.S. PATENT DOCUMENTS

| | | | |
|---|---|---|---|
| 2,994,280 | 8/1961 | Daffin | 166/133 |
| 3,645,328 | 2/1972 | Greene, Jr. | 166/85.3 |
| 3,856,081 | 12/1974 | Canalizo | 166/123 |
| 3,874,447 | 4/1975 | McGowen, Jr. | 166/214 |
| 4,153,111 | 5/1979 | Lans et al. | 166/85.1 X |
| 4,254,983 | 3/1981 | Harris | 294/86.25 X |
| 4,625,381 | 12/1986 | Gravonia, jr. et al. | 166/85.3 X |
| 4,793,411 | 12/1988 | Zunkel | 166/98 |
| 5,145,228 | 9/1992 | Boyle | 294/86.25 |
| 5,474,124 | 12/1995 | Samuels et al. | 166/85.1 |

*Primary Examiner*—George A. Suchfield
*Attorney, Agent, or Firm*—Henry C. Query, Jr.

[57] ABSTRACT

A retrieval tool for retrieving a back pressure valve and tree test plug (generally, a check valve) has a spear formed as a solid ring at the bottom with free fingers extending upward. The fingers are resilient and have protrusions adapted to engage a retrieval groove in the check valve. A wedge ring is provided on the tool body to positively lock the fingers in radially outward engagement with the retrieval groove. The wedge ring is fixed to the body by a shear pin so that upon a predetermined axial force the pin shears and releases the wedge ring allowing withdrawal of the tool assembly, if the check valve is stuck in a tubing hanger or coupling.

3 Claims, 2 Drawing Sheets

RETRIEVAL TOOL FOR BACK PRESSURE VALVE AND TREE TEST PLUG

BACKGROUND OF THE INVENTION

1. Field of the Invention

The present invention relates to wellhead service tools and, more particularly, to retrieval tools for check valves such as back pressure valves and tree test plugs.

2. Description of Related Art

A back pressure valve is a check valve installed in a tubing hanger or coupling to retain pressure in a well below the check valve. A tree test plug is a check valve installed in a tubing hanger or coupling to retain pressure in a Christmas tree above the check valve. Typically, a tree test plug is used to seal off pressure within the Christmas tree mounted on a well so that pressurized fluid can be used to test the Christmas tree. Back pressure valves and tree test plugs ordinarily have generally cylindrical bodies with an outside diameter slightly smaller than the bore of the well and are landed on a shoulder in the tubing hanger or coupling and secured by radially extending members.

Existing retrieval tools comprise generally ring-shaped, unitary bodies having axially extending "fingers" which are fixed to the ring body at the upper end and are freely extending at the lower end. The fingers have spring-like properties and together with the ring body form what is referred to as a "spear". The fingers are provided with members that extend radially outward and are adapted to engage a corresponding retrieval groove on the inner diameter of the check valve to be retrieved. The free ends or other portions of the fingers have wedge-shaped outer surfaces below the radially extending members in order to bias the fingers radially inward during insertion of the spear into the check valve until the extending members engage the groove causing the spring-like fingers to expand radially outward to lock the spear relative to the check valve. Once positioned and locked, the retrieval tool can be used to pull the check valve out of the tubing hanger or coupling.

Such existing retrieval tools are subject to several drawbacks during normal use. problems may arise when a gate valve of a Christmas tree is inadvertently left partially closed, restricting the open bore area through which the retrieval tool is supposed to pass. If, during insertion, one or more fingers gets caught on a partially closed gate, the free end of one or more of the fingers may be subjected to loads which may damage or deform the fingers. Similar problems can occur when a retrieval tool is run off-center through a blow out preventer stack or Christmas tree. permanent deformation of a finger may prevent the retrieval tool from properly engaging the check valve. Also, sometimes back pressure valves and tree test plugs get stuck inside the tubing hanger or coupling such that ordinary pulling or retrieval force cannot remove them. In such instances, it is desirable to have a retrieval tool which is capable of releasing from a stuck check valve.

SUMMARY OF THE INVENTION

The present invention provides a novel retrieval tool assembly for retrieving back pressure valves or tree test plugs, including means for releasing the retrieval tool from a stuck check valve. The retrieval tool comprises a spear which is formed as a solid ring at the bottom having free end fingers extending upward into a shrouded body. This design reduces the chance of the fingers getting caught on surrounding structure during insertion. The spear is structured such that in any situation all the fingers together resist collapse so that a compressing force would have to overcome the combined strength of all the fingers rather than one.

The retrieval tool is provided with means for engaging by radial expansion an inner circumferential retrieval groove in the back pressure valve or tree test plug. Further provided are means for releasing and withdrawing the retrieval tool from the check valve in the event that the check valve becomes stuck while the tool is pulling or lifting the check valve.

DETAILED DESCRIPTION OF THE PREFERRED EMBODIMENTS

Figure 1:
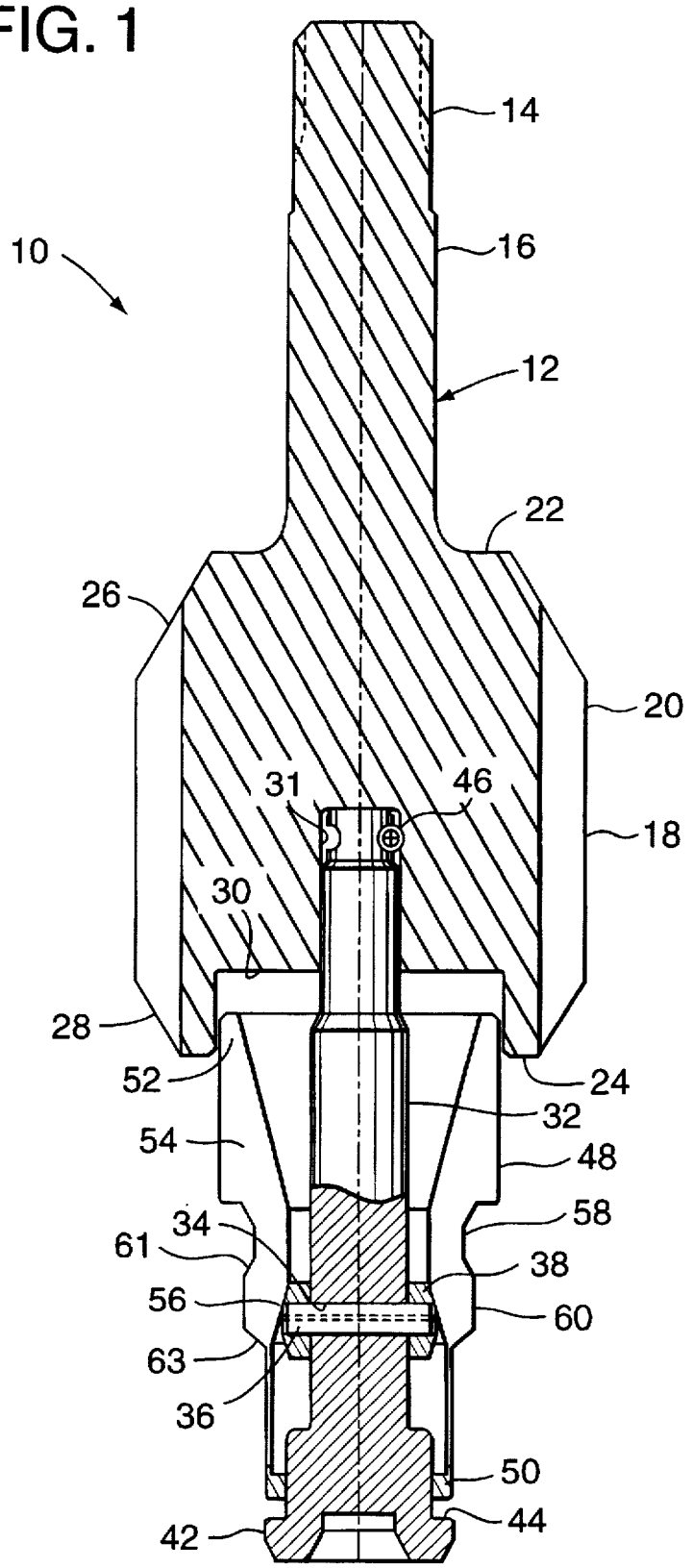
FIG. 1. is a partial, sectional view of the retrieval tool assembly of the present invention FIG. 2. is a partial, sectional split view of the retrieval tool assembly of the assembly of FIG. 1 engaged in a back pressure valve.

The present invention retrieval tool assembly 10 is illustrated in FIG. 1. The assembly 10 comprises a generally cylindrical body 12 having a first end 14 comprising a stem 16 adapted for engagement with conventional means (not shown) for operating and manipulating retrieval tools. The body 12 has a middle portion 18 having an enlarged diameter portion 20 with an upper end 22 and a lower end 24. The upper end 22 and lower end 24 are provided with beveled edges 26, 28, respectively. The lower end 24 of the body 12 is provided with a first axial recess 30 and a second axial recess 31 having a diameter smaller than the first recess 30. A stem 32 is fixed within recess 31 by a roll pin 46 or similar means and extends in a direction opposite the first end 14. The stem 32 is provided with a through hole 34 adapted to accommodate a shear pin 36 which supports a wedge ring 38 around the stem 32. The stem 32 has a lower end with a radially extending flange 42 having an upward-facing support surface 44. The assembly 10 is further provided with a spear 48 being formed of a solid ring section 50 at its lower end. The spear has a plurality of fingers 52 extending axially upwardly from ring section 50, preferably, the fingers 52 and ring 50 are unitary and the fingers 52 have spring properties. The spear 48 is positioned around the stem 32 such that the fingers 52 extend upward and are received in the axial recess 30 for protection. The inner surface 54 of each finger 52 has a wedge-like surface 56 adapted to engage the wedge ring 38 to limit downward movement of the spear 48. The outer surface 58 of each finger 52 is provided with a radially protruding, annular wedge member 60 having upper and lower wedge surfaces 61, 63 respectively.

Operation of the present invention is described with reference to FIG. 2 for a back pressure valve or a tree test plug, both being essentially the same for purposes of describing the present invention.

Figure 2:
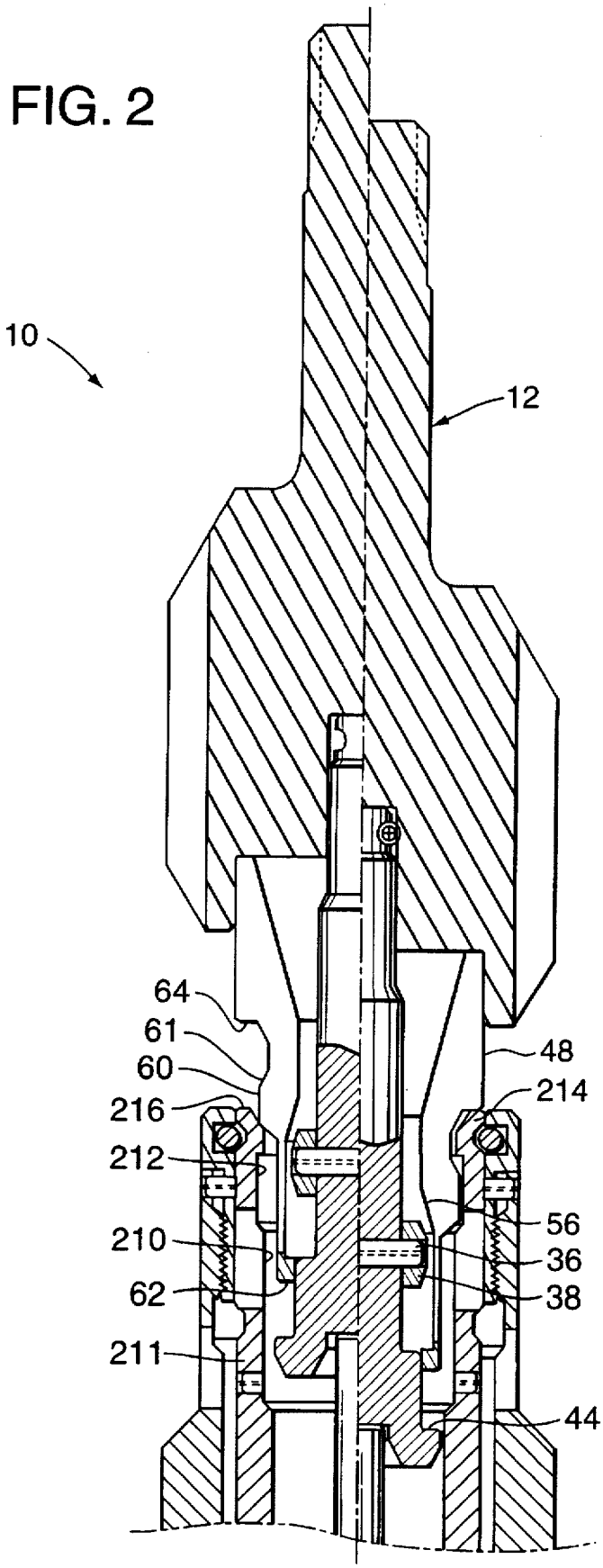

The retrieval tool assembly 10 is shown in the disengaged and engaged positions at the left and right sides of FIG. 2, respectively. The inner circumferential surface 210 of the mandrel 211 of the check valve has a dedicated retrieval groove 212 adapted for engagement with the wedge member 60. The assembly 10 is inserted such that the wedge member 60 lower surface 63 engages an angled upper edge 214 of the mandrel 211, causing the fingers 52 to be biased radially inward until the wedge surface 60 aligns with the retrieval groove 212. Once the wedge surface 60 is aligned with the retrieval groove 212, the fingers 52 spring radially outward so the wedge surface 60 is biased firmly into the retrieval groove 212. Continued downward movement will cause a positive stop surface 64 of the fingers 52 to contact a top surface 216 of the mandrel 211, thereby preventing further downward motion. At that point, the tool body 12 is raised, causing the wedge ring 38 to contact the surface 56 and lock wedge member 60 of the spear 48 into the retrieval groove 212. Further raising of the retrieval tool assembly 10 will then remove the check valve.

In the event that the check valve becomes stuck, the shear pin 36 will shear at a predetermined load, causing the wedge ring 38 to drop down from engagement with the surface 56. Then, continued movement of the body 12 will cause the support surface 44 to engage the lower end 62 of the spear 48 and provide upward force. This upward force causes the wedge member upper surface 61 to engage the inner circumferential surface 210 above the retrieval groove 212 and bias fingers 52 radially inward as the body 12 is withdrawn, releasing the wedge member 60 from the retrieval groove 212. Once the wedge member 60 is removed from the retrieval groove 212, the tool assembly 10 can be removed from the stuck check valve.

During the operation, the upward force can be applied by a human operator or by conventional mechanical or hydraulic means. While the check valve is being removed under normal conditions, there is no possibility that the fingers 52 will inadvertently be biased inward causing premature release of the check valve, since the wedge ring 38 prevents such biasing by being positioned against the fingers 52 at the surface 56.

While the preferred embodiment of the invention has been herein shown and described, it is understood that modification and variation can be made without departing from what is regarded as the scope of the present invention.

What is claimed is:

1. A retrieval tool assembly for retrieving a valve comprising:

a tool body having a first end and a second end;

said first end being adapted to receive means for grasping and manipulating said tool body;

a stem connected to said second end;

a spear comprising a generally ring-shaped base and a plurality of resilient fingers extending therefrom and having free ends opposite said base, said base being positioned generally concentrically around said stem such that said fingers extend toward said second end of said body;

said stem comprising integral retaining means adapted to retain said spear on said stem while permitting limited axial movement of said spear on said stem;

wedge means releasably fixed to said stem for engagement with an inner surface on each of said fingers when said body and said stem are moved relative to said spear, whereby said wedge means bias said fingers radially outward when said spear is moved axially relative to said body and said stem;

each said finger comprising engagement means extending radially outwardly for engaging an annular retrieval groove on an inner circumferential surface of said valve when said tool assembly is inserted concentrically in said valve; and shear means for releasably fixing said wedge means to said stem, said shear means being adapted to shear and release said wedge means from said stem, causing said wedge means to fall out of engagement with said inner surfaces when an axial force imposed on said wedge means attributable to said relative axial movement between said body, said stem, and said spear reaches a predetermined limit, whereby continued relative movement causes said retaining means to contact said spear and cause said spear to move with said body and said stem;

wherein said tool body comprises an axial recess formed in said second end, an end of said stem is received in said axial recess and the retaining means is formed adjacent the distal end of said stem.

2. A tool assembly according to claim 1, further comprising means for securing said stem in said recess.

3. X A tool assembly according to claim 2, wherein said securing means comprises a roll pin.

* * * * *